US011742164B2

(12) United States Patent
Ziegler

(10) Patent No.: US 11,742,164 B2
(45) Date of Patent: Aug. 29, 2023

(54) ELECTRICAL SWITCHING DEVICE, ESPECIALLY A CONTACTOR OR A RELAY, WITH A CONTACTING ELEMENT AND A FASTENING ELEMENT

(71) Applicant: TE Connectivity Germany GmbH, Bensheim (DE)

(72) Inventor: Titus Ziegler, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 191 days.

(21) Appl. No.: 17/197,492

(22) Filed: Mar. 10, 2021

(65) Prior Publication Data

US 2021/0287865 A1 Sep. 16, 2021

(30) Foreign Application Priority Data

Mar. 10, 2020 (DE) ..... 102020203056.1

(51) Int. Cl.

| | |
|---|---|
| ***H01H 50/14*** | (2006.01) |
| ***H01H 50/04*** | (2006.01) |
| ***H01R 4/30*** | (2006.01) |
| ***H01R 4/34*** | (2006.01) |

(52) U.S. Cl.

CPC ..... *H01H 50/14* (2013.01); *H01H 50/045* (2013.01); *H01R 4/308* (2013.01); *H01R 4/34* (2013.01)

(58) Field of Classification Search

CPC ..... H01H 50/14; H01H 50/045; H01H 50/54; H01H 50/021; H01H 51/065; H01H 1/14; H01H 1/06; H01H 1/5855; H01H 1/66; H01H 11/00; H01H 2011/0037; H01R 4/308; H01R 4/34

USPC ..... 200/239, 11 B, 507, 51 R

See application file for complete search history.

(56) References Cited

U.S. PATENT DOCUMENTS

| | | | | |
|---|---|---|---|---|
| 4,638,275 A * | 1/1987 | Belbel | H01H 50/22 | 335/154 |
| 4,931,757 A * | 6/1990 | Lemmer | H01H 89/06 | 335/8 |
| 5,493,085 A * | 2/1996 | Kolberg | H01R 4/34 | 361/624 |
| 5,631,613 A * | 5/1997 | Niimi | H01H 51/065 | 335/131 |

(Continued)

FOREIGN PATENT DOCUMENTS

| | | |
|---|---|---|
| EP | 0727840 A1 | 8/1996 |
| KR | 200417351 Y1 | 5/2006 |

OTHER PUBLICATIONS

Extended European search report in EP Appln. No. 21161652.9-1202, dated Jul. 20, 2021, 7 pp.

(Continued)

*Primary Examiner* — William A Bolton

(74) *Attorney, Agent, or Firm* — Barley Snyder

(57) ABSTRACT

An electrical switching device includes a connection section for fastening and contacting an electrical conductor. The connection section has a fastening element for fastening the electrical conductor, a current-carrying element spaced apart from the fastening element and including a contact point, and an electrically conductive contacting element extending from the fastening element to the contact point of the current-carrying element and into an inner section of the electrical switching device.

17 Claims, 5 Drawing Sheets

(56) References Cited

U.S. PATENT DOCUMENTS

| | | | | |
|---|---|---|---|---|
| 5,772,479 | A | 6/1998 | Fleege et al. | |
| 8,410,878 | B1 * | 4/2013 | Takaya | H01H 1/00 335/201 |
| 8,427,262 | B2 * | 4/2013 | Choi | H01H 50/045 335/132 |
| 9,887,056 | B2 * | 2/2018 | Lee | H01H 49/00 |
| 2008/0007373 | A1 * | 1/2008 | Andoh | H01H 50/20 335/38 |
| 2009/0288935 | A1 | 11/2009 | Larcher et al. | |
| 2010/0073117 | A1 * | 3/2010 | Daijima | H01F 41/10 29/606 |
| 2013/0052885 | A1 * | 2/2013 | Hausner | H01R 4/44 439/834 |
| 2014/0013583 | A1 | 1/2014 | Naka et al. | |
| 2017/0093051 | A1 * | 3/2017 | Belisle | H01R 43/00 |
| 2019/0386404 | A1 * | 12/2019 | Osswald | H01R 12/515 |

OTHER PUBLICATIONS

German Office Action, dated Nov. 10, 2020, 7 pages.
English translation of KR 200417351, dated May 26, 2006, 3 pages.
Examination Report from the European Patent Office dated Nov. 23, 2022, corresponding to Application No. 21 161 652.9-1201, 4 pages.

* cited by examiner

ELECTRICAL SWITCHING DEVICE, ESPECIALLY A CONTACTOR OR A RELAY, WITH A CONTACTING ELEMENT AND A FASTENING ELEMENT

CROSS-REFERENCE TO RELATED APPLICATIONS

This application claims priority under 35 U.S.C. § 119 to German Patent Application No. DE 10 2020 203 056.1, filed on Mar. 10, 2020.

FIELD OF THE INVENTION

The present invention relates to electrical switching devices, and more particularly, to contactors or relays for high-voltage applications in automotive engineering.

BACKGROUND

Electrical switching devices, in particular contactors and relays, are used in the field of electrical engineering as electro-mechanically acting switches for closing or opening electrical circuits in countless devices and systems. Switching devices allow for the influence of comparatively strong current flows with comparatively weak control currents.

In the field of automotive engineering, the number of applications that have a need for such switches to influence current is increasing with the advancement of electromobility. The use of switches in vehicles, however, requires that special requirements be fulfilled with regard to weight, the required installation space, electrical safety, the achievable switching cycles, and the production costs, which do not necessarily apply to general electrical engineering applications.

Accordingly, there is a need for improved electrical switching devices, in particular contactors and relays, with regard to weight-related, geometrical, safety-related and/or economic aspects.

SUMMARY

In one embodiment of the present disclosure, an electrical switching device includes a connection section for fastening and contacting an electrical conductor. The connection section has a fastening element for fastening the electrical conductor, a current-carrying element spaced apart from the fastening element and including a contact point, and an electrically conductive contacting element extending from the fastening element to the contact point of the current-carrying element and into an inner section of the electrical switching device.

BRIEF DESCRIPTION OF THE DRAWINGS

The invention will now be described by way of example with reference to the accompanying Figures, of which.

DETAILED DESCRIPTION OF THE EMBODIMENTS

Figure 1:
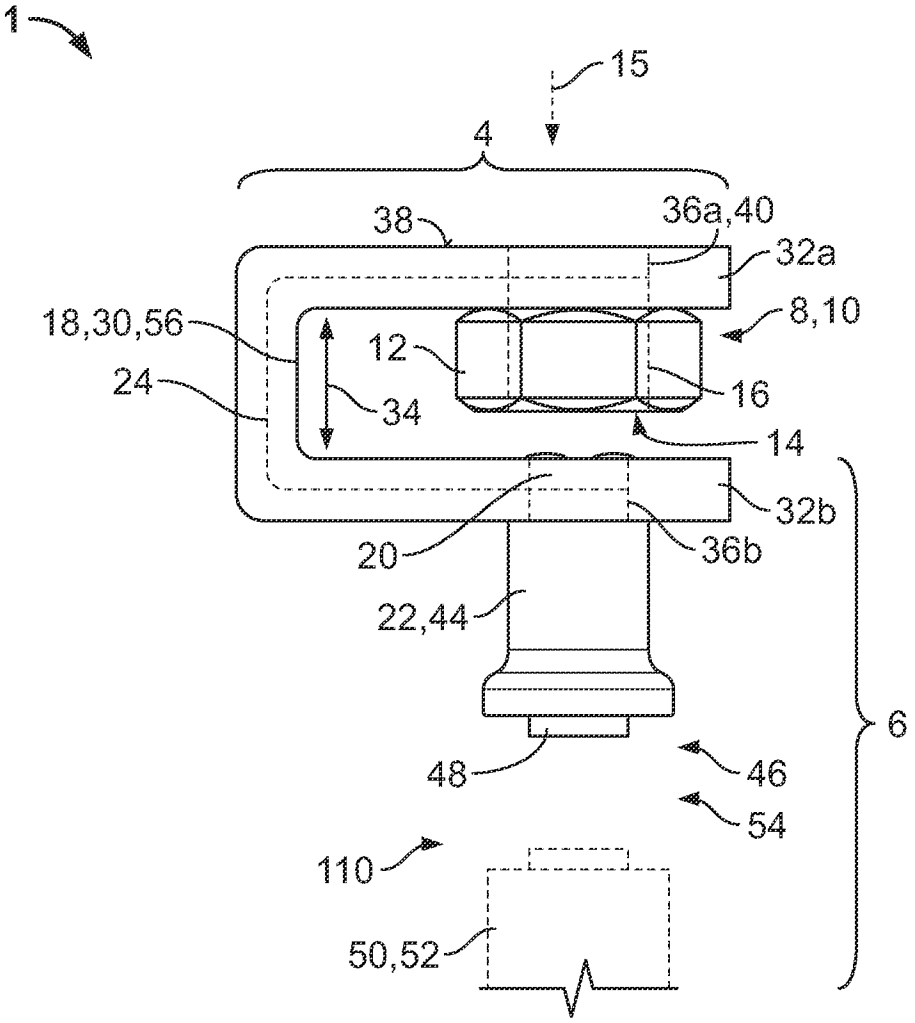
FIG. 1 shows a schematic side view of an electrical switching device of the invention according to an exemplary embodiment.

Technical solutions of the present disclosure will be described hereinafter in detail through embodiments and with reference to the attached drawings. In the specification, the same or the like reference numerals refer to the same or the like elements. The illustration of the embodiments of the present disclosure made with reference to the attached drawings is aimed to explain the general inventive concept of the present disclosure, not to be construed as a limitation of the present disclosure.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

The schematic configuration of an electrical switching device 1 according to the invention shall be explained with reference to FIGS. 1 to 6.

As shown in FIG. 1, electrical switching device 1 according to the invention may include a connection section 4 and an inner section 6. A fastening element 8 can be present on connection section 4. Fastening element 8 optionally includes an insertion opening 14 which extends along a direction of insertion 15 through fastening element 8. Insertion opening 14 has a circular cross section and serves to receive an electrical conductor 26 or a fixation element 28 of electrical conductor 26, respectively (see FIG. 5). Alternatively, this can also be a slot-shaped, triangular, quadrangular, pentagonal, hexagonal or polygonal insertion opening.

In the exemplary embodiment shown, fastening element 8 is configured as a screw-nut 10. Screw-nut 10 has in particular a hexagonal outer shape 12 and an internal thread 16 in insertion opening 14.

Furthermore, an electrically conductive contacting element 18 can be disposed at connection section 4, with contacting element 18 extending from fastening element 8 at least up to a contact point 20 of a current-carrying element 22 which is spaced from fastening element 8 and runs in inner section 6.

Contacting element 18 can be configured to be clamp-shaped. As shown in FIG. 1, contacting element 18 can be formed in particular as a U-shaped clamp 30 having two legs 32*a*, 32*b* extending in parallel. Spacing 34 of legs 32*a*, 32*b* is preferably selected such that contacting element 18 configured as a clamp 30 can engage around fastening element 8.

On at least one of the legs 32*a*, contacting element 18 can include an opening 36*a* that is aligned with insertion opening 14 in the direction of insertion 15. In the embodiment shown, aligned opening 36*a* is realized by a bore 40 passing through a contact surface 38 of contacting element 18.

The other leg 32*b* can likewise include an opening 36*b* that is aligned or not aligned with insertion opening 14 in the direction of insertion 15. Contact point 20 can be disposed in opening 36*b*. As shown in FIG. 1, current-carrying element 22 can, in particular, be configured as a rivet head 44 and riveted to contacting element 18 at contact point 20. Alternatively, current-carrying element 22 can also be implemented as a screw head (not shown).

A contact member 48 can be located at an end 46 of current-carrying element 22 facing away from contact point 20. Contact member 48 can be arranged in particular opposite to a complementary switching mechanism element 50, for example, a contact bridge 52, and together form an electrical switching mechanism 110. This arrangement results in a separation point 54 at which an electrical circuit, into which electrical switching device 1 is integrated, can be closed or opened, respectively.

Contacting element 18 can be fabricated from a sheet metal material. Contacting element 18 is optionally a stamped and bent member 56. Alternatively, contacting element 18 can also be a cast or forged member.

Figure 6:
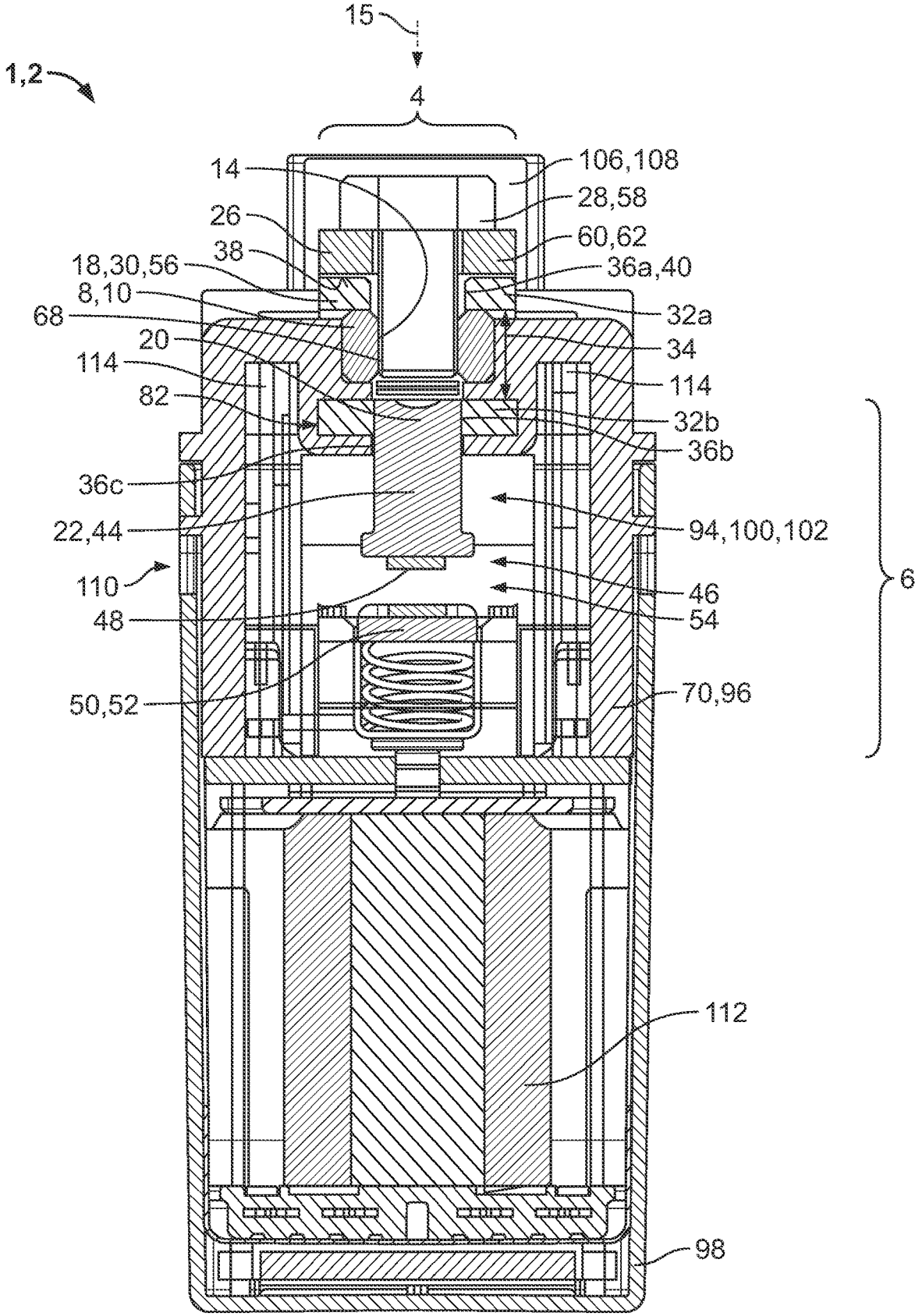
FIG. 6 shows a schematic sectional illustration of the electrical switching device according to the invention of FIG. 5.

As shown in FIG. 6, fixation element 28 of electrical conductor 26 can be inserted through bore 40 of contact element 18 into insertion opening 14 of fastening element 8. Electrical conductor 26 may electrically contact contact surface 38 of contacting element 18.

Figure 5:
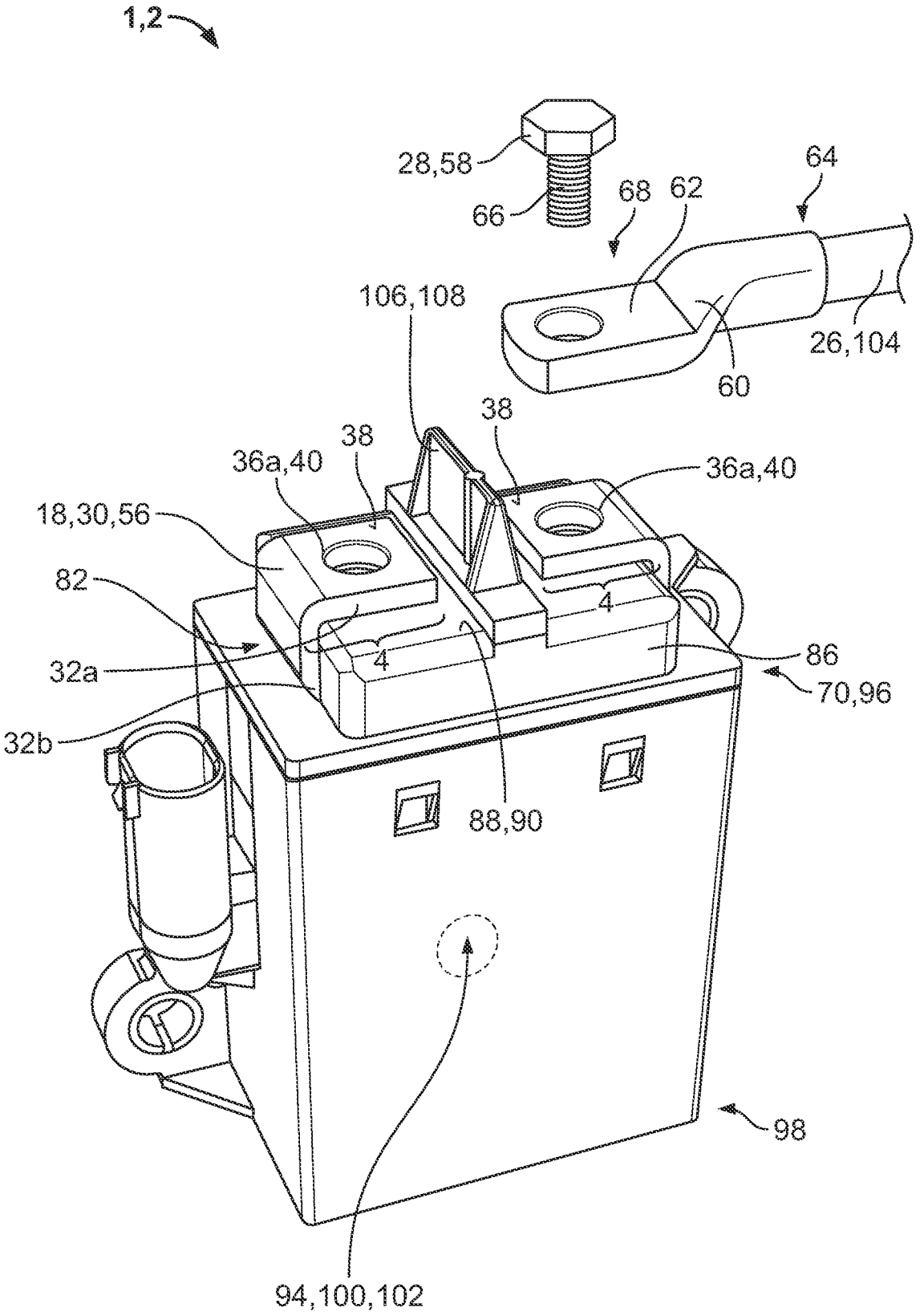
FIG. 5 shows a schematic perspective illustration of the electrical switching device of the invention according to a further exemplary embodiment.

As can be seen from FIG. 5, a retaining screw 58 can be used as fixation element 28 for electrical conductor 26. For this purpose, electrical conductor 26 can comprise, for example as shown, a cable lug 60 with an eyelet 62, wherein cable lug 60 is attached to one end 64 of electrical conductor 26.

Retaining screw 58 comprises an external thread 66 which is compatible with internal thread 16 of fastening element 8 when configured as a screw-nut 10, and can be used to establish a releasable screw connection 68. As an alternative to retaining screw 58, for example, a banana plug (not shown) can also be used as a fixation element 28 for electrical conductor 26 and be inserted into insertion opening 14. The banana plug can correspondingly be attached as part of cable lug 60 in place of eyelet 62 on end 64 of electrical conductor 26.

Fastening element 8 preferably has a greater mechanical strength than contacting element 18. In addition, contacting element 18 can be electrically conductive and preferably exhibit greater electrical conductivity than fastening element 8. Fastening element 8 is disposed in particular outside an intended current path 24 of electrical switching device 1. In this way, fastening element 8 can be configured gearing solely towards mechanical requirements. A current-conducting function is provided by contacting element 18 and the current-carrying element 22. In particular, fastening element 8 does not substantially need to fulfill any electrically conductive task, so that expensive materials that are sufficiently strong and at the same time sufficiently conductive, such as high-purity copper or other precious metals, can be dispensed with in fastening element 8. A material, which is characterized exclusively by high mechanical strength such as steel, preferably having a low volume requirement at the same time, can instead be selected for fastening element 8. Thus, weight, space requirements, and/or costs can be saved by employing an electrical switching device.

Fastening element 8 and contacting element 18 can be separate components that can be detached from one another. Alternatively, there can be a permanent connection, for example, a welded, soldered or adhesive bond, between fastening element 8 and contacting element 18.

Figure 2:
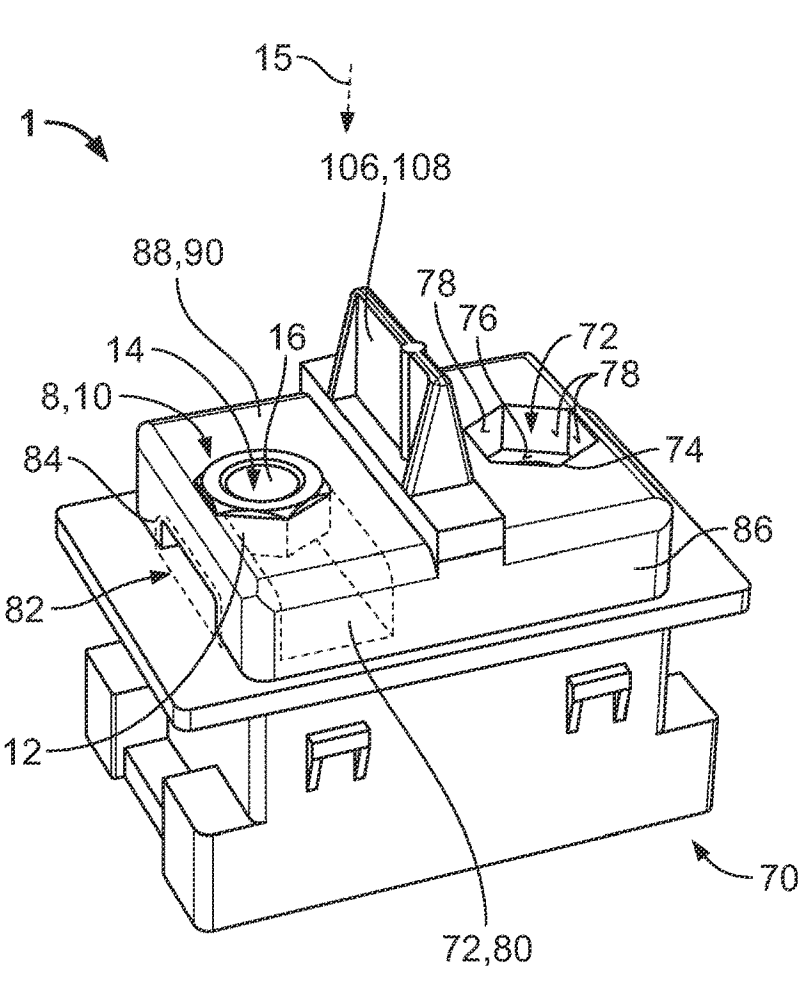
FIG. 2 shows a schematic perspective illustration of a housing and a fastening element of the electrical switching device of the invention according to a further exemplary embodiment.

Referring now to FIG. 2, electrical switching device 1 can also include a housing 70, wherein the housing has at least one recess 72 for receiving fastening element 8. In the embodiment shown, two recesses 72 are provided, in each of which a fastening element 8 configured as a screw-nut 10 can be inserted, preferably removable in a direction opposite to the direction of insertion 15. Recesses 72 can have a shape that is complementary to fastening element 8. In the exemplary embodiment, due to fastening element 8 being configured as a screw-nut 10 with a hexagonal outer shape 12, recesses 72 have a hexagonal inner shape 74 that matches the hexagonal outer shape 12. This means that recesses 72 each consist of a lowered, hexagonal base surface 76 and six side surfaces 78 each abutting against an edge of base surface 76. The spacing between two opposite side surfaces 78 corresponds to the width across flats of hexagonal outer shape 12.

Optionally, recess 72 can have a lateral access 80 which runs perpendicular to the direction of insertion 15. This is indicated in FIG. 2 for one recess 72 by dashed lines. Access 80 can optionally connect both recesses 72 to one another.

Still referring to FIG. 2, housing 70 can include at least one receiving slot 82. The at least one receiving slot 82 can have a rectangular cross section 84 and extends perpendicular to the direction of insertion 15 through housing 70. In particular, the at least one receiving slot 82 can extend in the direction of insertion 15 overlapping with one of recesses 72 and fastening element 8 placed therein. In this way, the at least one receiving slot 82 is optionally arranged between connection section 4 and inner section 6, more precisely between fastening element 8 and current-carrying element 22, as shown in FIG. 6.

Figure 3:
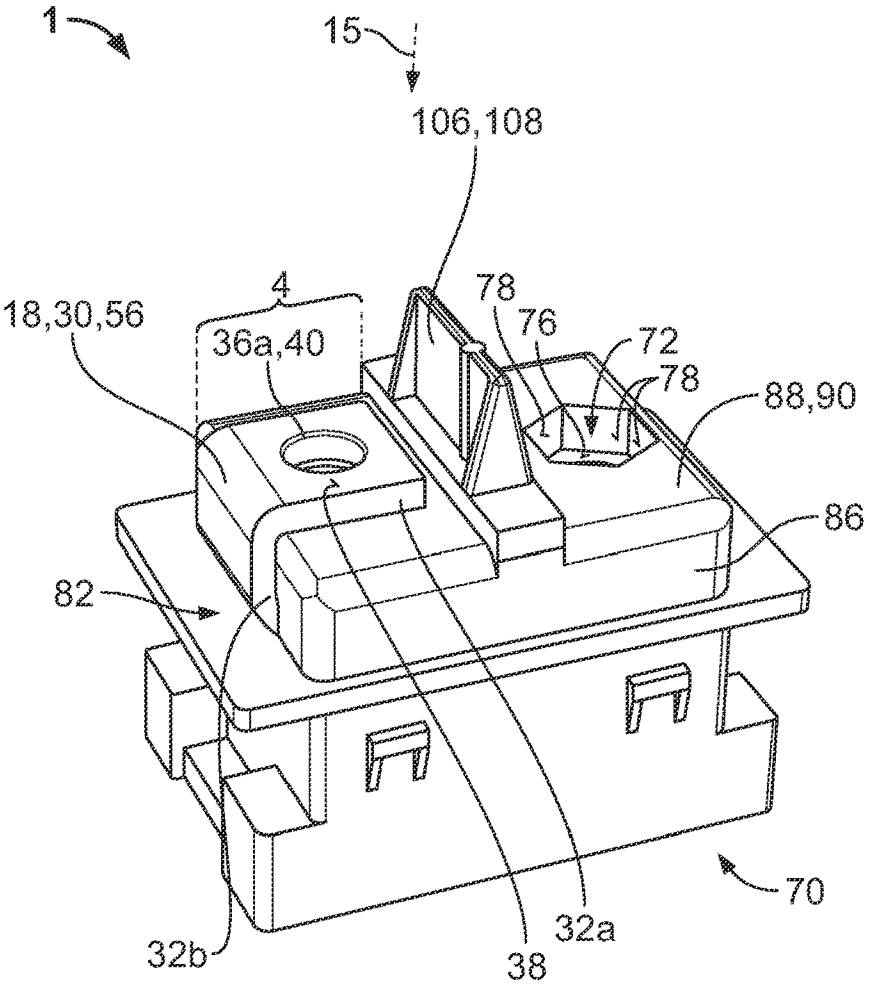
FIG. 3 shows a schematic perspective illustration of the housing and a contacting element of the electrical switching device of the invention according to a further exemplary embodiment.

Contacting element 18 configured as a clamp 30 can protrude with one leg 32*a*, 32*b* into the at least one receiving slot 82. Advantageously, leg 32*b* with opening 36*b* is introduced, plugged or pushed into the at least one receiving slot 82. This is shown in FIG. 3, wherein contacting element 18 configured as a clamp 30 covers fastening element 8 at least in sections with the other leg 32*a* towards the outside. Fastening element 8 can thus be secured or held in the corresponding recess 72 by contacting element 18. Connection section 4, in particular contact surface 38 of contacting element 18, is accessible from the outside, for example, for contacting through electrical conductor 26.

Referring to FIG. 3, connection section 4 can be arranged on an elevated portion 86 of housing 70. Elevated portion 86 can be located in particular on an outer side 88 of housing 70, preferably on an upper side 90 of housing 70 pointing in a direction opposite to the direction of insertion 15. Further, the at least one recess 72 and the at least one receiving slot 82 can be formed into elevated portion 86.

Figure 4:
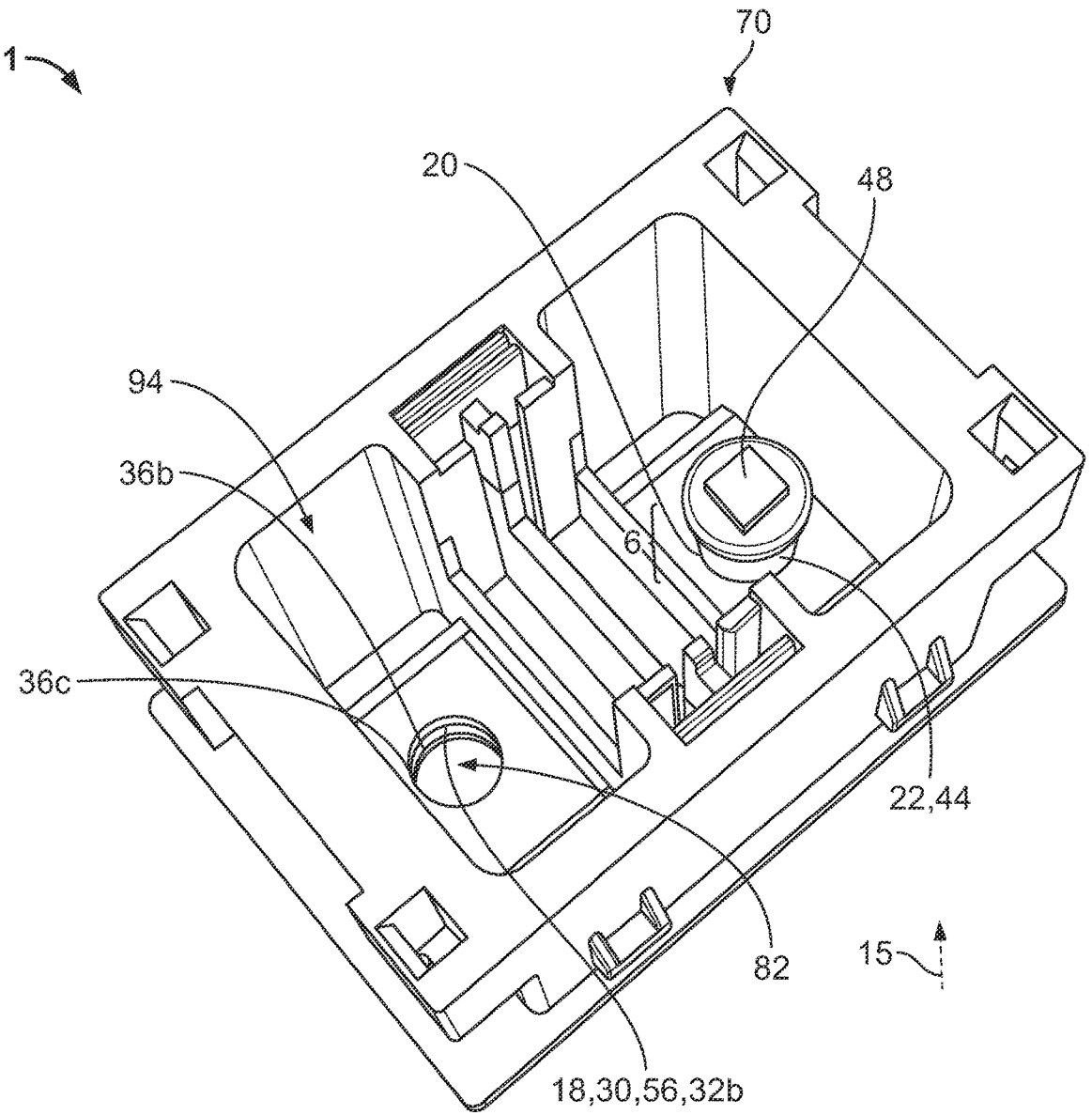
FIG. 4 shows a schematic perspective illustration of the housing and a current-carrying element of the electrical switching device of the invention according to a further exemplary embodiment.

FIG. 4 shows a bottom view of housing 70, from which it can be seen that the at least one receiving slot 82 can be connected via an opening 36*c* to an interior 94 of housing 70. Opening 36*c* is advantageously aligned with opening 36*b* of leg 32*b* when leg 32*b* with opening 36*b* is inserted, plugged or pushed into the at least one receiving slot 82. In exemplary embodiment shown, current-carrying element 22 is configured as a rivet head 44 and can protrude in part through opening 36*c* into opening 36*b* and be riveted to contacting element 18. Contact point 20 can accordingly be arranged in the at least one receiving slot 82. This is shown, for example, in FIG. 6. As can also be seen in FIG. 6, contacting element 18 can connect connection section 4 to interior 94 of housing 70.

Electrical switching device 1 shown by way of example as a contactor 2 in FIG. 5 can include at least one connection section 4. At least two connection sections 4 are preferably provided in pairs on electrical switching device 1, in particular on housing 70 of electrical switching device 1. Furthermore, electrical switching device 1 can comprise a shell-shaped housing cover 98 which can be connected to housing 70 configured as a complement 96, so that a preferably gas-tight interior 100 is created in inside 102 of electrical switching device 1.

For each connection section 4, electrical switching device 1 preferably comprises a power cable 104 which is fastened to and contacted on the associated connection section 4. This attachment can be effected as explained above for electrical conductor 26. Connection sections 4 are preferably arranged on the same outer side 88 of housing 70 and may be separated from one another by a rib-shaped web 106 protruding from housing 70 in a direction opposite to direction of insertion 15.

In the embodiment shown, rib-shaped web 106 is shown as an end-to-end rib 108. To simplify the process of placing fastening element 8 into recess 72, rib 108 can comprise a centrally arranged break (not shown). For reasons of electrical safety, it must be ensured that the break is narrower than power cable 104 so that power cable 104 cannot pass through the break.

In interior 100 of electrical switching device 1, current-carrying elements 22 in pairs can be part of an electrical switching mechanism 110. For this purpose, a complementary switching mechanism element 50, for example, a contact bridge 52, is arranged or disposed opposite respective contact members 48 in interior 100 of electrical switching device 1. Contact bridge 52 is moved in accordance with incoming switching commands by way of an actuating coil 112 that is likewise located in interior 100 of electrical switching device 1.

It can be seen in the sectional illustration in FIG. 6 that chambers 114 can be formed in housing 70 perpendicular to the direction of insertion 15 next to receiving slot 82. Chambers 114 extend interior 100 of electrical switching device 1, so that interior 100 provides additional space for expanding arcs which arise between contact member 48 and contact bridge 52 during a separation process of electrical switching mechanism 110.

The electrical switching device shown as contactor 2 can be a DC contactor or an AC contactor. Alternatively, the present invention can also be used in relays or similar electrical switches.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the present disclosure have been described hereinbefore in detail with reference to the attached drawings, it should be appreciated that the disclosed embodiments in the attached drawings are intended to illustrate the preferred embodiments of the present disclosure by way of example, and should not be construed as limitation to the present disclosure.

Although several exemplary embodiments have been shown and described, it would be appreciated by those skilled in the art that various changes or modifications may be made to these embodiments without departing from the principles and spirit of the invention, the scope of which is defined by the claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the present disclosure.

What is claimed is:

1. An electrical switching device, comprising:

a connection section for fastening and contacting an electrical conductor, including:

a fastening element for fastening the electrical conductor, wherein the fastening element includes an insertion opening for receiving the electrical conductor;

a current-carrying element spaced apart from the fastening element and extending into an inner section of the electrical switching device and including a contact point; and an electrically conductive contacting element extending from the fastening element to the contact point of the current-carrying element, wherein the contacting element includes an opening aligned with the insertion opening, wherein a fixation element of the electrical conductor is inserted through a bore of the contacting element and extends into the insertion opening of the fastening element, and the insertion opening, current carrying element, and contact point are axially aligned.

2. The electrical switching device according to claim 1, wherein the electrical switching device further includes a housing having a recess receiving the fastening element.

3. The electrical switching device according to claim 2, wherein the fastening element is secured by the contacting element.

4. The electrical switching device according to claim 3, wherein the contacting element at least partially covers the fastening element.

5. The electrical switching device according to claim 4, wherein the contacting element is clamp-shaped.

6. The electrical switching device according to claim 5, wherein the contacting element protrudes into a receiving slot.

7. The electrical switching device according to claim 6, wherein the receiving slot is arranged between the connection section and the inner section.

8. The electrical switching device according to claim 7, wherein the contact point is arranged in the receiving slot.

9. The electrical switching device according to claim 8, wherein the current-carrying element is a screw head or rivet head fastened to the contacting element.

10. The electrical switching device according to claim 9, wherein the connection section is arranged on an elevated portion of the housing.

11. The electrical switching device according to claim 10, wherein the contacting element is at least partially inserted between the elevated portion and a remainder of the switching device.

12. The electrical switching device according to claim 1, wherein the inner section includes an electrical switching mechanism and the current-carrying element is part of the electrical switching mechanism.

13. The electrical switching device according to claim 12, wherein the connection section comprises a plurality of connection sections.

14. The electrical switching device according to claim 1, wherein the fastening element has a greater mechanical strength than the contacting element, and the contacting element has a greater electrical conductivity than the fastening element.

15. An electrical switching device, comprising:

a housing defining a recess, a receiving slot, and an interior space; and a connection section for fastening and contacting an electrical conductor, the connection section including:

a fastening element received within the recess for fastening the electrical conductor, wherein the fastening element defines an insertion opening for receiving the electrical conductor;

a current-carrying element spaced apart from the fastening element, the current-carrying element extending into the interior space of the housing and including a contact point; and an electrically conductive contacting element at least partially arranged within the receiving slot and extending from the fastening element to the contact point of the current-carrying element, wherein the contacting element includes an opening aligned with the insertion opening, wherein a fixation element of the electrical conductor is inserted through a bore of the contacting element and extends into the insertion opening of the fastening element, and the insertion opening, current carrying element, and contact point are axially aligned.

16. The electrical switching device according to claim 15, wherein the contacting element is a U-shaped clamp.

17. An electrical switching device, comprising:

a housing having a recess receiving a fastening element;

a connection section for fastening and contacting an electrical conductor, including:

a fastening element for fastening the electrical conductor, the fastening element including an insertion opening for receiving an electrical conductor, wherein the fastening element is secured by a contacting element;

a current-carrying element spaced apart from the fastening element and extending into an inner section of the electrical switching device, wherein the current-carrying element is a screw head or rivet head fastened to the contacting element, the current-carrying element including a contact point, wherein the contact point is arranged in the receiving slot; and an electrically conductive clamp-shaped contacting element extending from the fastening element to the contact point of the current-carrying element, wherein the contacting element further includes an opening aligned with the insertion opening at least partially covers the fastening element, and the contacting element protrudes into a receiving slot arranged between the connection section and the inner section.

* * * * *